US010584565B2

(12) United States Patent
Golian et al.

(10) Patent No.: US 10,584,565 B2
(45) Date of Patent: Mar. 10, 2020

(54) INDICATOR SCALLOP CIRCULATOR

(71) Applicant: Hunting Titan, Inc., Pampa, TX (US)

(72) Inventors: Timothy G. Golian, San Antonio, TX (US); William Richard Collins, Burleson, TX (US); Shane Matthew Wilson, Waxahachie, TX (US)

(73) Assignee: Hunting Titan, Inc., Pampa, TX (US)

( * ) Notice: Subject to any disclaimer, the term of this patent is extended or adjusted under 35 U.S.C. 154(b) by 93 days.

(21) Appl. No.: 15/313,047

(22) PCT Filed: May 21, 2015

(86) PCT No.: PCT/US2015/032005
§ 371 (c)(1),
(2) Date: Nov. 21, 2016

(87) PCT Pub. No.: WO2015/179663
PCT Pub. Date: Nov. 26, 2015

(65) Prior Publication Data

US 2017/0198559 A1 Jul. 13, 2017

Related U.S. Application Data

(60) Provisional application No. 62/001,313, filed on May 21, 2014.

(51) Int. Cl.

| | |
|---|---|
| ***E21B 43/117*** | (2006.01) |
| ***E21B 43/119*** | (2006.01) |
| ***F42B 3/02*** | (2006.01) |
| ***F42B 3/08*** | (2006.01) |

(52) U.S. Cl.
CPC ..... *E21B 43/117* (2013.01); *E21B 43/119* (2013.01); *F42B 3/02* (2013.01); *F42B 3/08* (2013.01)

(58) Field of Classification Search
CPC ..... E21B 43/116; E21B 43/117; E21B 43/119
See application file for complete search history.

(56) References Cited

U.S. PATENT DOCUMENTS

| | | | | |
|---|---|---|---|---|
| 3,128,702 | A | 4/1964 | Christopher | |
| 5,007,486 | A | 4/1991 | Ricles | |
| 5,598,891 | A * | 2/1997 | Snider | E21B 27/02 166/297 |
| 2002/0185275 | A1 | 12/2002 | Yang et al. | |
| 2005/0173118 | A1 | 8/2005 | Li et al. | |
| 2012/0175109 | A1 | 7/2012 | Richard | |

OTHER PUBLICATIONS

Notification of Transmittal of the International Search Report and the Written Opinion of the International Searching Authority, PCT Application No. PCT/US15/32005, dated Aug. 17, 2015, 12 pages.

(Continued)

*Primary Examiner* — D. Andrews
(74) *Attorney, Agent, or Firm* — Christopher McKoen; Jason Saunders; Arnold & Saunders, LLP

(57) ABSTRACT

A device for perforating a perforating gun body, while leaving adjacent tubulars unperforated, adapted for situations where it may be desirable to use a perforating gun with a loaded number of shaped charges that is less than its full capacity.

16 Claims, 3 Drawing Sheets

(56) References Cited

OTHER PUBLICATIONS

Notification concerning transmittal of international preliminary report on patentability, PCT Application No. PCT/US15/32005, dated Dec. 1, 2016, 11 pages.
Supplementary European Search Report, EP application No. 15795670.7 dated Oct. 16, 2017, 7 pages.
Office Action, Canadian application No. 2,933,222, dated May 25, 2017, 3 pages.
Response to Office Action, Canadian application No. 2,933,222, dated Nov. 22, 2017, 11 pages.

* cited by examiner

INDICATOR SCALLOP CIRCULATOR

RELATED APPLICATIONS

This application is the non-provisional of U.S. Provisional Application No. 62/001,313, filed May 21, 2014.

BACKGROUND OF THE INVENTION

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a weft-known method in the art for accessing hydrocarbon deposits within a formation from a wellbore.

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

Explosively perforating the formation using a shaped charge is a widely known method for completing an oil well. A shaped charge is a term of art for a device that when detonated generates a focused explosive output. This is achieved in part by the geometry of the explosive in conjunction with a liner in the explosive material. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder, which is a tube that is designed to hold the actual shaped charges. The charge holder will contain cutouts called charge holes where the shaped charges will be placed.

A perforating gun may have scallops machined on the exterior surface for each shaped charge. The purpose of the scallop is to provide a flat uniform spot for the explosive jet to easily puncture with minimal effect on the direction or strength of the jet. Furthermore, when a perforating gun is pulled out of a hole after detonation, a hole located in a scallop is an obvious sign that the shaped charge behind it exploded. One of the fears in the field is that unexploded ordinance may be brought to the surface. Further, when sending off a gun to be recycled, the recyclers will demand that the gun tube is free from unexploded ordinance. A blasted hole in every scallop is evidence that there is no unexploded ordinance.

In some instances not all of the shaped charge spots are used. There are applications where a limited number of shaped charges are needed. It may result in one or more of the charge holes in the charge tube going unfilled. There are cases were they may be more scallops in the perforating gun than shaped charges. In these situations there will be no perforated holes in the scallops where there are no shaped charges. This presents a problem to the crew pulling the gun out of the hole because there could be confusion as to whether the missing perforation on a scallop is the result of intentionally loading fewer shaped charges or because there is unexploded ordinance still inside the gun. The problem of confusion continues when the perforating gun tube is sent to a recycler. The recycler cannot tell if the absence of a hole in a scallop is because there was no shaped charge behind the scallop or because the shaped charge failed to explode. This uncertainty may cause a recycler to refuse to accept a gun tube.

SUMMARY OF EXAMPLES OF THE INVENTION

This invention is aimed at solving the problem of making sure scallops are perforated in all cases. This invention provides for using a smaller specialized indicator charge that is designed to puncture through the scallop. Further, the indicator charge is designed to be powerful enough to breach a scallop while minimizing damage to the adjacent casing. This provides the client with the option to either fill all of the charge tubes with shaped charges, or if they need to reduce the number of shaped charges, then the unused charge holes can instead have indicator charges placed there. This allows for the perforating of all scallops, regardless of the number of shaped charges used in the perforating gun.

An example of the invention may include a device for perforating a gun body comprising a charge case adaptor, an indicator charge further comprising an indicator charge case, a liner, and explosive material wherein the indicator charge is adapted to engage the charge case. A variation of the example may include the explosive material having a weight of approximately 3.5 grams. The invention may also include the indicator charge snapping into the charge case adaptor. The invention may also include the indicator charge clipping into the charge case adaptor. The indicator charge may be pressed into the charge case adaptor. The indicator charge may be adapted to puncture a perforating gun scallop without puncturing an adjacent tubular. The perforating gun in this example may be an expendable gun system.

Another example of the invention may include an indicator shaped charge for perforating a gun body scallop comprising a charge case, a liner, and explosive material. The explosive material may be sized to puncture the gun body scallop without damaging adjacent tubulars. The explosive material may weighs approximately 3.5 grams. The indicator charge may snap, clip, or screw into a charge case adaptor. The indicator charge may also be press fitted into a charge case adaptor. The perforating gun may be an expendable gun system.

Another example of the invention may include a method for perforating a wellbore comprising installing shaped charges, for a preselected number of scallops, into a perforating gun, installing an indicator charge into the perforating gun for each remaining scallops of the perforating gun, placing the perforating gun at a preselected location within a wellbore, detonating the perforating gun at the preselected location, removing the perforating gun from the wellbore, and confirming that all of the scallops of the perforating gun have been perforated. A variation of the embodiment may include snapping each indicator charge into a charge case adaptor, clipping each indicator charge into a charge case, or pressing each indicator charge into a charge case. The method may include recycling the perforating gun. The method may include perforating all of the scallops of the perforating gun. Furthermore, the indicator charge may be less powerful than the shaped charges. The design is such that the indicator charge does not perforate tubulars beyond the indicator scallop.

In all of above examples a charge case adaptor is a device that fastens to an indicator charge and also fastens to the perforating gun, generally via the charge tube within the perforating gun. The charge case adaptor may fasten to the shaped charge indicator with threads, press fitting, adhesive, clipping on, or snapping into place. The charge case adaptor may be a regular shaped charge case with the indicator placed inside. The charge case adaptor may be a specially design case with a through hole, possibly tapered, that accommodates the explosive output of the indicator charge.

DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
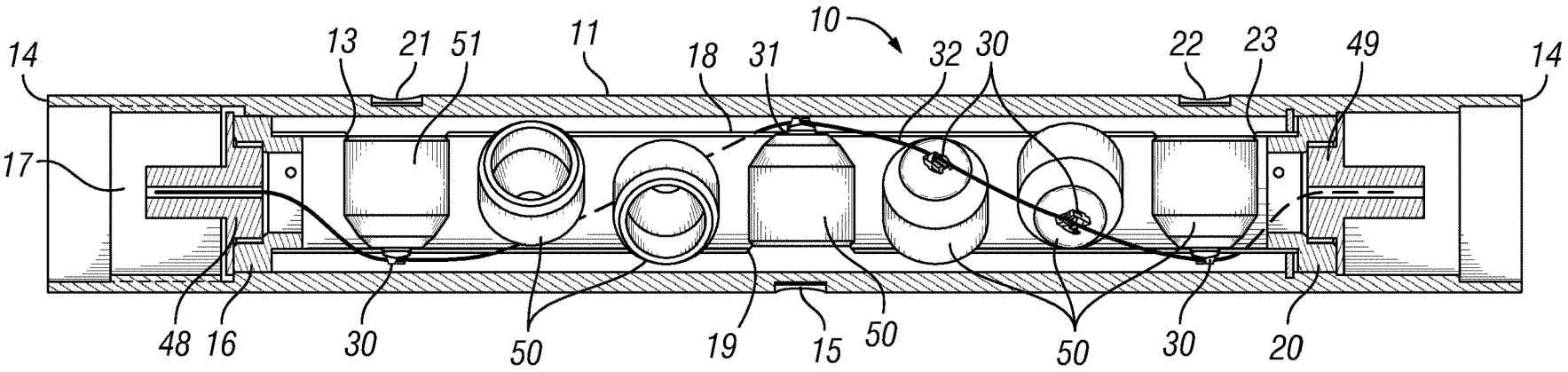
FIG. 1 is a cross section of an example of a perforating gun.

Referring to FIG. 1, a typical perforating gun 10 comprises a gun body 11 that houses the shaped charges 50. The gun body 11 contains end fittings 16 and 20 securing the charge tube 18 into place. The charge tube 18 has charge holes 23 that are openings where shaped charges 50 may be placed. The gun body 11 has threaded ends 14 that allow it to be connected to a series of perforating guns 10 or to other downhole equipment depending on the job requirement. Other design variations may use ends that are bolted together. In FIG. 1, a 60 degree phase gun is shown where each shaped charge 50 is rotate about the center axis by 60 degrees from one shaped charge to the next. Other embodiments of this design are possible including zero degree phase guns, where all the shaped charges are aligned. Other end fittings or connections could be used in lieu of threaded fittings, such as bolted fittings.

The shaped charges 50 each include a shaped charge case that holds the explosive material and a liner. The shaped charge 50 case typically is composed of alloy steel. The liner is usually composed of a powdered metal that is either pressed or stamped into place. The metals used in liner include brass, copper, tungsten, and lead.

The outer surface of the perforating gun 10 has scallops 23 corresponding to each charge hole 23. The scallop 23 is a flat machined spot on the perforating gun 10 that allows the explosive jet from the shaped charge 50 to penetrate less metal, therefore saving energy for the perforating job. The scallop 23 also reduces any lensing effects whereby the direction of the explosive jet may be altered due to the curvature of the perforating gun 10. A charge case adaptor 51 substitutes for a shaped charge 50. The charge case adaptor 51 contains an indicator charge, as described in further detail below. Charge case adaptor 51 is associated with scallop 21.

Figure 2:
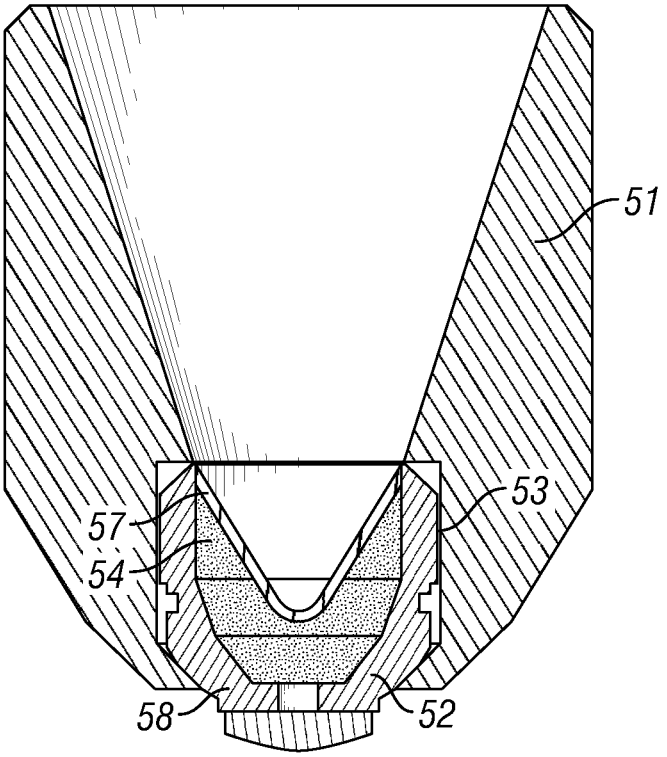
FIG. 2 is an example of an indicator charge in a charge case adaptor.

Referring to FIG. 2, an example of the invention may include a device for perforating a gun body 11 comprising a charge case adaptor 51 engaged with an indicator charge 52. The indicator charge 52 comprises an indicator charge case 58, a liner 57, and explosive material 54 located between the liner 57 and the indicator charge case 58. Charge case adaptor 51 can fit into existing charge holes 23. This allows the scallop indicator charge 52 to be installed in a regular charge hole 23. The explosive material in a typical shaped charge 50 may be between 19 and 39 grams. In this example the indicator charge 52 uses approximately 3.5 grams of explosive material 54. This is enough explosive material to puncture the scallop 21 while leaving any adjacent tubulars, including the well casing, substantially undamaged.

Figure 3:
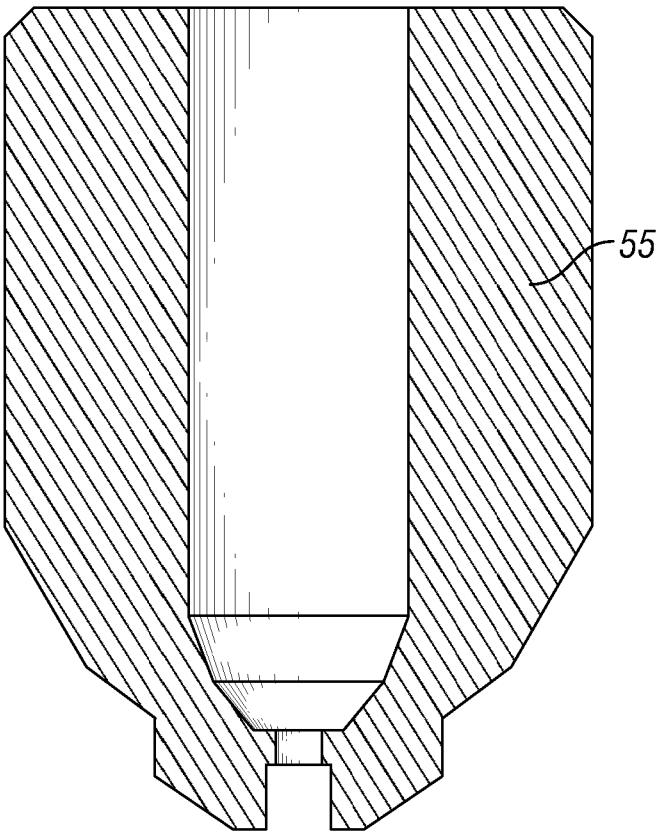
FIG. 3 is an example of a charge case adaptor.
Figure 4:
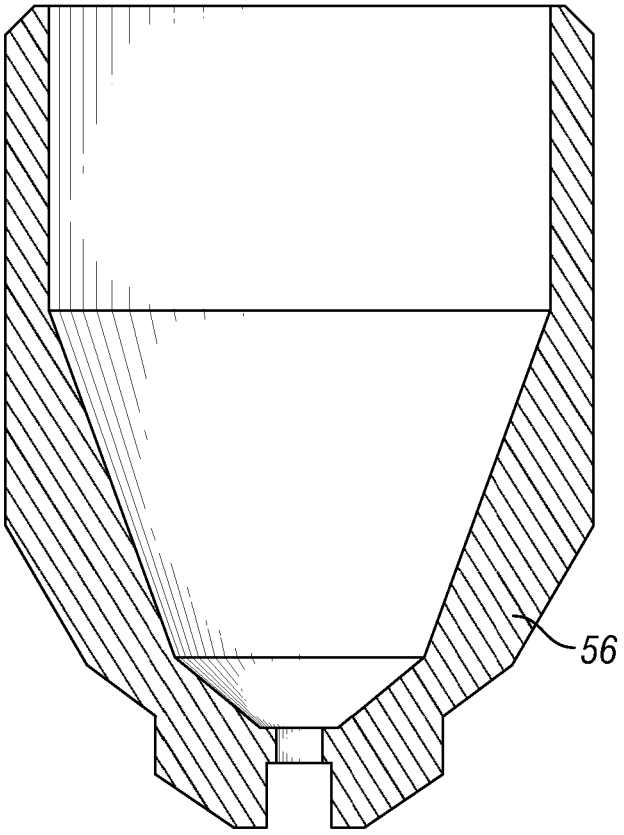
FIG. 4 is an example of a charge case adaptor.

The indicator charge 52 may be adapted to fit inside a specially designed charge case adaptor 51 as shown in FIG. 2. The indicator charge 52 may be adapted to fit inside of an empty charge case adaptor 55 as shown in FIG. 3. The indicator charge 52 may be adapted to fit into a shaped charge case 56, such as the example shown in FIG. 4. The alternative charge case adaptor 55 differs from the charge case adaptor 51 in that it does not have a frusto-conical inner surface. Instead the inner surface, of the through hole, of the alternative charge case adaptor 55 remains a near constant inner diameter through most of the length of the case.

The indicator charge 52 can be secured to a charge adaptor 51, an alternative charge adaptor 55, or a charge case 56 using a variety of means, including clipping the indicator charge into place, pressing the indicator charge place, screwing the indicator charge 52 into place, snapping the indicator charge 52 into place, or using adhesive to hold the indicator charge 52 into place within the charge adaptor 51. The purpose for using the indicator charge 52 within a regular sized shaped charge case 56 is to allow the indicator charge to be installed into a charge tube 18 in place of a normal shaped charge 50. Other designs can be used, such as an indicator charge integral to a large case that can fit into a regular charge tube. Another variation of the embodiment may include a stand-alone indicator charge adapted to fit inside a regular sized charge hole 23 in the charge tube 18, but using the smaller amount of explosive to only puncture the scallop.

The indicator charge 52 may be used with expendable gun systems where the perforating gun 10 is a single use gun tube. After use it will be inspected to ensure all of the scallops 22 have been perforated. The punctured scallops 22 provide visual confirmation to the operator that all of the explosive ordinance detonated. Then the perforating gun 10 will be sent to a recycling center. Since all of the scallops 22 will have holes in them, the recyclers will know that there are no unexploded shape charges 50 inside the perforating gun 10.

Another example of the invention may include a method for perforating a wellbore comprising installing shaped charges 50 into the charge tube 18 of a perforating gun 10 for a preselected number of scallops 22. In this example, as shown in FIG. 1, there are places for 7 shaped charges 50 at 60 degrees of phase. Only the first 6 charge holes, beginning at charge hole 23 will be filled with shaped charges 50. Then an indicator charge 52 may be installed into the perforating gun 10 for remaining scallop 21 of the perforating gun 10. In this example the last scallop 21 will have an indicator charge adaptor 51 installed at the last charge hole 13 with an indicator charge 52 installed therein. The perforating gun 10 is then placed at a preselected location within a wellbore. The perforating gun is then detonated at the preselected location. The six shaped charges 50 will perforate the associated scallops 22 of the perforating gun 10 and then continue to perforate the casing and the surrounding formation. The indicator charge located within the charge adaptor 51, at the seventh charge hole, will only puncture its associated scallop 21, but not the casing. Afterwards, the perforating gun 10 is removed from the wellbore. A visual examination of the perforating gun 10 will reveal that all seven scallops have been perforated. The perforating gun 10 can then be sent to a recycling center.

In this example the indicator charge 52 is placed inside a regular sized shaped charge case adaptor 51. The indicator charge 52 can be engaged to the shaped charge case adaptor 51 by snapping, clipping, press fitting, screwing, adhesive, or other mechanical means known in the art. The indicator charge 52 uses less explosive material than the shaped charges 50, allowing it to only puncture the scallop 21 while leaving the casing or any other adjacent tubulars substantially undamaged at the predetermined location.

What is claimed is:

1. A perforating gun comprising:

a cylindrical body with a charge tube disposed therein containing a plurality of shaped charges;

a charge case adaptor, in the place of one of the shaped charges, having an inner bore defined by an inner surface;

an indicator charge disposed within the charge case adaptor further comprising:

an indicator charge case;

a liner; and explosive material;

wherein the indicator charge is adapted to engage the charge case adaptor and is configured to puncture the cylindrical body disposed within a wellbore casing without perforating the wellbore casing.

2. The perforating gun of claim 1, wherein the explosive material weighs 3.5 grams.

3. The perforating gun of claim 1, wherein the indicator charge is pressed into the charge case adaptor.

4. The perforating gun of claim 1, wherein the perforating gun is an expendable gun system.

5. The perforating gun of claim 1, wherein the charge case adaptor is adapted to engage the charge tube.

6. An indicator shaped charge comprising:

a charge case configured to couple to a charge case adaptor, wherein the charge case adaptor is configured to couple to a charge holder within a perforating gun;

a liner in the charge case; and explosive material in the charge case, wherein the indicator shaped charge is configured to puncture a gun body scallop when disposed within a wellbore casing without perforating the wellbore casing.

7. The indicator shaped charge of claim 6, wherein the explosive material weighs 3.5 grams.

8. The indicator shaped charge of claim 6, wherein the charge case is adapted to press fit into the charge case adaptor.

9. The indicator shaped charge of claim 6, wherein the perforating gun is part of a perforating gun that is an expendable gun system.

10. A method for perforating a wellbore comprising:

installing shaped charges into a charge holder, for a first preselected number of scallops;

installing at least one indicator charge into a shaped charge adaptor;

installing the shaped charge adaptor into the charge holder;

installing the charge holder into a perforating gun;

placing the perforating gun at a preselected location within a wellbore;

detonating the perforating gun at the preselected location; and removing the perforating gun from the wellbore.

11. The method of claim 10, further comprising confirming that all of the scallops of the perforating gun have been perforated.

12. The method of claim 10, further comprising pressing each indicator charge into a respective shaped charge adaptor.

13. The method of claim 10, further comprising recycling the perforating gun.

14. The method of claim 10, further comprising perforating all of the scallops of the perforating gun.

15. The method of claim 10, wherein the at least one indicator charge has less explosive material than the shaped charges.

16. The method of claim 10, wherein the at least one indicator charge does not perforate tubulars beyond the perforating gun.

* * * * *